US010495321B2

(12) United States Patent
Park et al.

(10) Patent No.: US 10,495,321 B2
(45) Date of Patent: Dec. 3, 2019

(54) GAS FURNACE FOR HEATING INDOOR SPACE AND CONTROLLING METHOD THEREOF

(71) Applicant: LG ELECTRONICS INC., Seoul (KR)

(72) Inventors: Janghee Park, Seoul (KR); Yongki Jeong, Seoul (KR); Baikyoung Chung, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 317 days.

(21) Appl. No.: 15/379,100

(22) Filed: Dec. 14, 2016

(65) Prior Publication Data

US 2017/0176024 A1 Jun. 22, 2017

(30) Foreign Application Priority Data

Dec. 22, 2015 (KR) ..... 10-2015-0183892

(51) Int. Cl.
*F24H 9/20* (2006.01)
*F24D 19/10* (2006.01)

(52) U.S. Cl.
CPC ..... *F24D 19/1084* (2013.01)

(58) Field of Classification Search
CPC ..... F24D 19/1084; F24D 2220/042
USPC ..... 431/12; 126/116 A; 231/1 C; 237/2 A, 237/53; 236/1 C
See application file for complete search history.

(56) References Cited

U.S. PATENT DOCUMENTS

2005/0092317 A1* 5/2005 Hugghins ..... F23N 1/002 126/116 A
2013/0312730 A1* 11/2013 Stark ..... G05D 16/2013 126/116 A

FOREIGN PATENT DOCUMENTS

KR 10-1992-0016794 A 9/1992
KR 10-2002-0013274 A 2/2002
KR 10-2006-0097454 A 9/2006

* cited by examiner

*Primary Examiner* — Vivek K Shirsat
(74) *Attorney, Agent, or Firm* — Dentons US LLP

(57) ABSTRACT

A gas furnace for heating an indoor space including a burner forming high-temperature exhaust gas by combusting fuel; an exhaust path in which the exhaust gas flows; a blower for suctioning internal air via a suction path; a supply path for guiding the internal air exhausted by the blower toward the indoor space, after heat-exchanged with the exhaust path; a valve of which an opening degree is controllable so as to supply a predetermined heat-power-based amount of fuel to the burner; and a controller controlling the opening degree of the valve based on a signal transmitted from a thermostat installed in the indoor space, wherein the heat power of the burner is controlled in different heat power levels based on the opening degree of the valve, and a controlling method of the gas furnace for heating the indoor space.

17 Claims, 6 Drawing Sheets

GAS FURNACE FOR HEATING INDOOR SPACE AND CONTROLLING METHOD THEREOF

Pursuant to 35 U.S.C. § 119(a), this application claims the benefit of earlier filing date and right of priority to Korean Application No. 10-2015-0183892, filed on Dec. 22, 2015, the contents of which are hereby incorporated by reference herein in their entirety.

BACKGROUND OF THE DISCLOSURE

Field of the Disclosure

The disclosure relates to a gas furnace that heats an indoor space by supplying warm air via heat exchange between internal air and hot exhaustion gas generated by combustion of fuel, and a controlling method thereof. More particularly, the disclosure relates to a gas furnace for heating an indoor space including one valve of which a heating power is controllable by multi-steps, and a controlling method thereof.

Discussion of the Related Art

In general, a gas furnace is a device used for heating an indoor space.

A gas furnace generally includes a burner for fuel combustion. The gas furnace provides heat by adjusting the amount of the fuels supplied to the burner. In other words, the controlling of the heating is the controlling of the heating intensity. The amount of fuel supplied to the burner is controlled by a valve. Typically, the supply and shut-off of fuels may be controlled by using a solenoid valve which is an on/off controllable valve.

For example, FIG. 1 schematically illustrates a fuel supply unit including a conventional valve for controlling the amount of the fuel supplied to the burner. Referring to FIG. 1, the fuel supply unit 1 includes a fuel line 3 for supplying fuel to the burner 2 and two solenoid valves 4-1 and 4-2 provided in the fuel line 3. The two solenoid valves 4-1 and 4-2 may include a first solenoid valve 4-1 and a second solenoid valve 4-2. The first solenoid valve 4-1 may be arranged in a front portion with respect to fuel flow, compared with the second solenoid valve 42.

When receiving no signal from a controller (not shown), the first solenoid 4-1 is maintained in an initial closed state and the second solenoid valve 4-2 is maintained in an initial state in which it partially opens the fuel line 3. At this time, the fuel is not supplied to the burner 2.

The controller may control ON and OFF of the first and second solenoid valves 4-1 and 4-2 based on a signal transmitted from a thermostat (not shown) searched in the indoor space.

When receiving a middle heat-power signal from the controller, the first solenoid valve 4-1 is completely open and the second solenoid valve 4-2 maintains the initial state in which it has partially opened the fuel line 3.

When receiving a high heat-power level signal from the controller, the first solenoid valve 4-1 and the second solenoid valve 4-2 are completely open.

As mentioned above, the conventional gas furnace is able to control the heat power of the burner 2 via two levels, based on the two signals transmitted by the thermostat and the ON/OFF control of the two solenoid valves 4-1 and 4-2.

Meanwhile, the conventional gas furnace uses the thermostat generating the two signals and the two solenoid valves 4-1 and 4-2, so that it has a disadvantage of incapability of controlling the heat power of the burner 2 by three or more difference heat force (in other words, heating intensities).

In addition, the conventional gas furnace uses two or more solenoid valves 4-1 and 4-2 to control two or more heat powers and cannot help requiring the securing of the installation space for installing the plurality of the valves and having the complex flow path disadvantageously.

The conventional gas furnace is incapable of controlling the heat power linearly and has the complex flow path for the fuel supply, only to have a relatively high production cost.

Lastly, the conventional gas furnace is capable of controlling only the two steps of heat power based on the two signals transmitted from the thermostat, only to have a disadvantage of a large temperature difference in the indoor space.

SUMMARY OF THE DISCLOSURE

To solve at least the above described disadvantages of the conventional technology, the present disclosure provides a gas furnace for an indoor space that is capable of controlling the heat power (e.g., heat intensity) of a burner in three or more levels by using one valve, and a controlling method thereof.

Exemplary embodiments of the present disclosure also provide a gas furnace for an indoor space that uses one valve only to provide a compact structure and simplify a path of the fuel flowing toward the burner, and a controlling method thereof.

Exemplary embodiments of the present disclosure also provide a gas furnace for an indoor space which is capable of reducing production cost by minimizing the number of valves and simplifying of the fuel flow path, and a controlling method thereof.

Exemplary embodiments of the present disclosure also provide a gas furnace for an indoor space which is capable of minimizing a temperature difference in an indoor space by controlling heat power in three levels, while using a thermostat generating only two signals, and a controlling method thereof.

Exemplary embodiments of the present disclosure also provide a gas furnace for an indoor space which includes a burner forming high-temperature exhaust gas by combusting fuel, an exhaust path in which the exhaust gas flows, a blower for suctioning internal air via a suction path, a supply path for guiding the internal air exhausted by the blower toward the indoor space after being heat-exchanged with the exhaust path, a valve of which an opening degree is controllable so as to supply a predetermined heat-power-based amount of fuel to the burner, and a controller controlling the opening degree of the valve based on a signal transmitted from a thermostat installed in the indoor space, wherein the heat power of the burner is controlled in different heat power levels based on the opening degree of the valve.

At this time, the heat power of the burner may be controlled to be a small heat power, a middle heat power and a large heat power based on the opening degree of the valve.

Specifically, the controller may perform a first control for controlling the heat power of the burner based on a difference (Ts−Ti) between a preset target temperature (Ts) and the room temperature (Ti) sensed by a temperature sensor provided in the thermostat, and when the difference (Ts−Ti) is smaller than a preset value, the opening degree of the valve may be controlled for the heat power of the burner to be the middle heat power for a first time period in the first control, and when the difference (Ts−Ti) is the preset value or more, the opening degree of the valve may be controlled for the heat power of the burner to be the middle heat power for a second time period and then the large heat power for a third time period in the first control.

At this time, the first time period and the third time period may be longer than the second time period, and the first time period may be longer than the third time period.

The controller may perform a second control for controlling the heat power of the burner, based on determination about whether the room temperature (Ti) reaches the target temperature (Ts) after the first control, and the opening degree of the valve may be controlled for the heat power of the burner to be at least one of the small heat power and the middle heat power in the second control.

Specifically, in the second control, the controller may control the opening degree of the valve for the heat power of the burner to be the small heat power for the third time period when the room temperature (Ti) is lower than the target temperature (Ts) and control the valve to be completely closed when the room temperature (Ti) is the target temperature (Ts) or more.

The controller may control the opening degree of the valve for the heat power of the burner to be the middle heat power for the second time period, when the room temperature (Ti) is lower than the target temperature (Ts) even after controlling the opening degree of the valve for the heat power of the burner to be the small heat power.

The controller may repeat the control of the valve opening degree for the heat power of the burner to be the middle heat power after the small heat power, until the room temperature (Ti) reaches the target temperature (Ts) or more in the second control.

Exemplary embodiments of the present disclosure also provide a controlling method of a gas furnace for heating an indoor space including a controller controlling an opening degree of a valve supplying fuel to a burner, based on a signal transmitted from a thermostat installed in the indoor space, the controlling method including: a temperature setting step for setting a target temperature via the thermostat; a temperature measuring step for measuring a room temperature by using a temperature sensor provided in the thermostat; a first valve controlling step for controlling the opening of the valve for the heat power of the burner to be at least one of a middle heat power and a large heat power, based on a difference between the target temperature and the room temperature; and a second valve controlling step for controlling the opening degree of the valve for the heat power of the burner to be at least one of a small heat power and the middle heat power, based on determination about whether the room temperature reaches the target temperature.

At this time, the first valve controlling step may comprise a first middle heat power controlling step for controlling the opening of the valve for the heat power of the burner to be the middle heat power for a first time period, when the difference valve (Ts−Ti) is smaller than a preset value; a second middle heat power controlling step for controlling the opening of the valve for the heat power of the burner to be the middle heat power for a second time period, when the difference value (Ts−Ti) is the preset value or more; and a large heat power controlling step for controlling the opening degree of the valve for the heat power of the burner to be the large heat power for a third time period after the second middle heat power controlling step.

The second valve controlling step may comprise a first determining step for determining whether the room temperature reaches the target temperature or more; and a small heat power controlling step for controlling the opening degree of the valve for the heat power of the burner to be the small heat power for the third time period, when it is determined in the first determining step that the room temperature is lower than the target temperature.

The controlling method of the gas furnace for heating the indoor space of may further comprise a second determining step for re-determining whether the room temperature reaches the target temperature or more after the small heat power controlling step; and a third middle heat power controlling step for controlling the opening degree of the valve for the heat power of the burner to be the middle heat power for the second time period, when it is determined in the second determining step that the room temperature is lower than the target temperature.

The small heat power controlling step and the third middle heat power step may be performed sequentially and repeatedly, until the room temperature reaches the target temperature or more.

The room temperatures measured by the temperature sensor before the first determining step and the second determining step may be transmitted to the controller.

The first time period and the third time period may be longer than the second time period, and the first time period is longer than the third time period.

According to the embodiments of the present disclosure, the gas furnace for an indoor space may be capable of controlling the heat power (in other words, heat intensity) of a burner in three or more levels by using one valve, and a controlling method thereof.

Furthermore, the gas furnace for an indoor space may use one valve only to realize a compact structure and simplify a path of the fuel flowing toward the burner, and a controlling method thereof.

Still further, the gas furnace for an indoor space which is capable of economizing in production cost by minimizing the number of valves and simplifying of the fuel flow path, and a controlling method thereof.

Still further, the gas furnace for an indoor space may be capable of minimizing a temperature difference in an indoor space by controlling heat power in three levels, while using a thermostat generating only two signals, and a controlling method thereof.

Details of other embodiments are included in the detailed description and drawings.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention. In the drawings:

FIG. 4(*b*) is a diagram illustrating the structure of a valve applied to the gas furnace for the indoor space shown in FIG. 3, where the valve is partially closed;

FIG. 4(*c*) is a diagram illustrating the structure of a valve applied to the gas furnace for the indoor space shown in FIG. 3, where the valve is fully opened;

DESCRIPTION OF SPECIFIC EMBODIMENTS

Advantages and features of the present disclosure and methods for achieving the merits and characteristics will be more clearly understood from embodiments described in detail later in conjunction with the accompanying drawings. However, the present disclosure is not limited to the disclosed embodiments, but may be implemented in various different ways. The embodiments are provided to only complete the disclosure of the present disclosure and to allow a person having ordinary skill in the art to which the present disclosure pertains to completely understand the category of the invention. The present disclosure is only defined by the category of the claims. The same reference numbers are used to refer to the same or similar elements throughout the specification.

Figure 1:
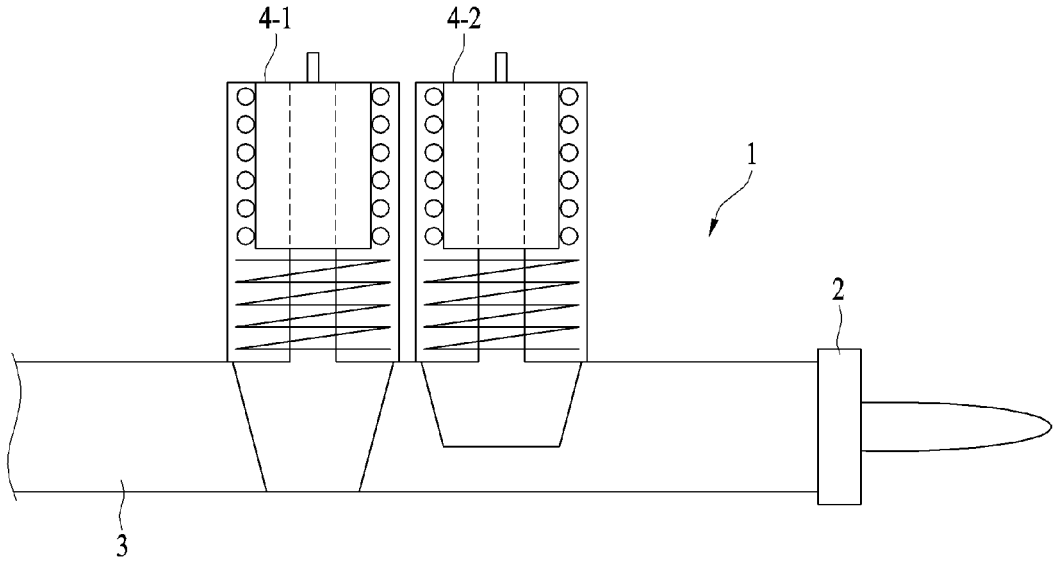
FIG. 1 is a schematic diagram illustrating a gas furnace including a valve for controlling the amount of fuel that is supplied to a conventional burner.
Figure 2:
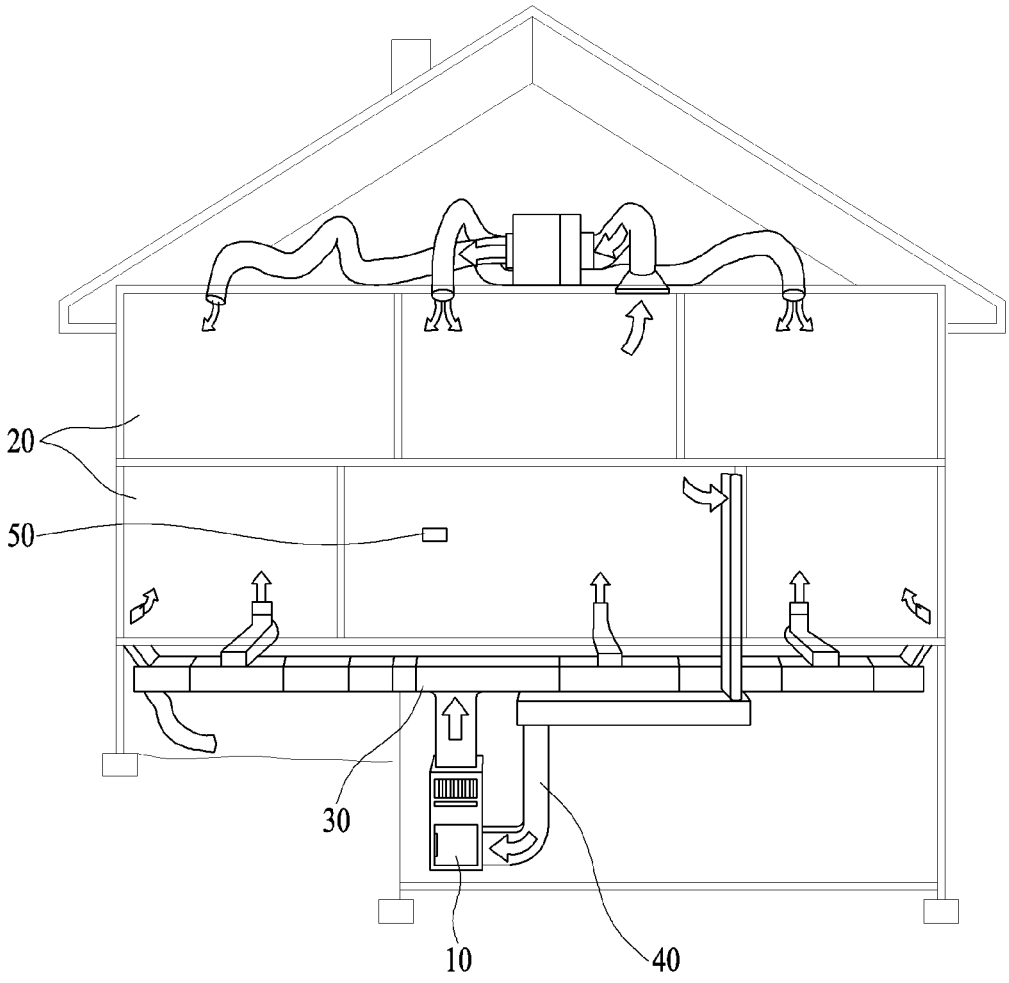
FIG. 2 is a schematic diagram illustrating a gas furnace in accordance with an embodiment of the present disclosure that is applied to an indoor space as a heating object space.

FIG. 2 is a schematic diagram illustrating a gas furnace in accordance with an embodiment of the present disclosure that is applied to an indoor space as a heating object space. With reference to FIG. 2, a gas furnace for an indoor space 10 is configured to supply heated air to the indoor space through heat-exchange between room air and high-temperature exhaust gas that is generated by fuel combustion. The fuel may be gas fuel or liquid fuel.

For example, as shown, the gas furnace 10 may be configured to supply the heated air to one or more indoor spaces 20 via a supply path 30. A supply duct may be provided as the supply path 30.

In case of two or more indoor spaces 20, the supply path 30 may be also branched into two or more paths to supply the heated air to the indoor spaces 20, respectively.

Internal air of the indoor spaces 20 may be collected in the gas furnace 10 via a collect path 40 in communication with the indoor spaces 20. The supply path 30 and the collect path 40 may be arranged in difference areas of the indoor space 20.

For example, the supply path 30 may be arranged at one side wall of the indoor space 20 and the collect path 40 may be arranged at the ceiling of the indoor space 20. Alternatively, the supply path 30 may be arranged at the ceiling of the indoor space, or room 20 and the collect path 40 may be arranged in one wall of the indoor space. Of course, the supply path 30 may be arranged in one side wall and the collect path 40 may be arranged in another wall of the indoor space 20.

One or more thermostats 50 (e.g., temperature regulators) may be installed in the indoor space 20. A temperature sensor may be provided in the thermostat 50.

Accordingly, the gas furnace for the indoor space 10 may be operated based on a signal transmitted from the thermostat 50.

Hereinafter, the structure of the gas furnace for the indoor space 10 in accordance with another embodiment of the invention will be described, with reference to FIG. 3.

Figure 3:
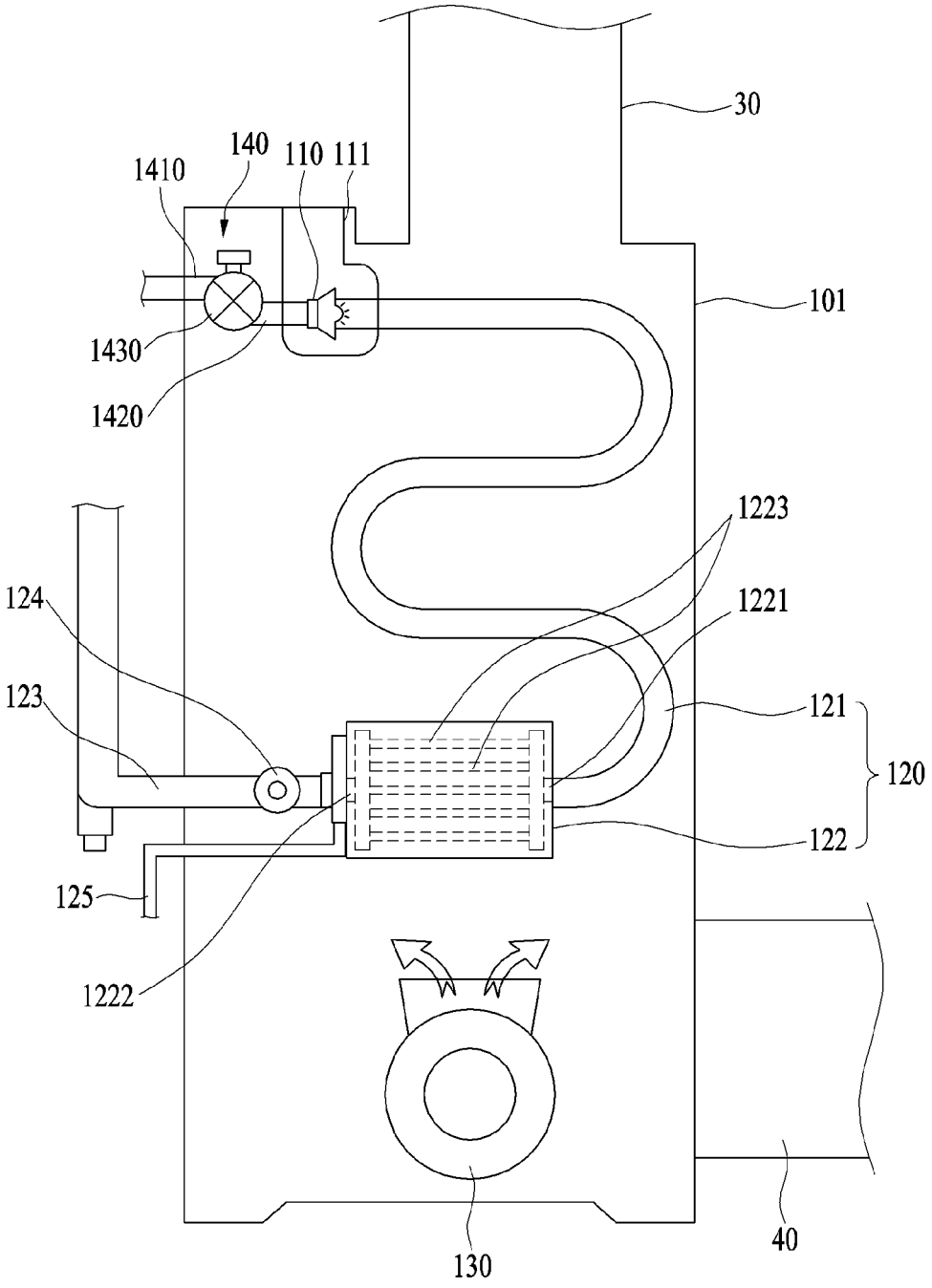
FIG. 3 schematically illustrates the structure of the gas furnace in accordance with an embodiment of the present disclosure.

As shown in FIG. 3, the gas furnace 10 includes a burner formed to combust fuel, an exhaust path 120 in which exhaust gas flows, a blower 130 suctioning internal air via a collect path 40, a supply path 30 guiding the internal air after heat exchanged in the exhaust path 120 into the indoor space or a room, and a fuel supply unit 140 formed to supply fuel to the burner 110.

The burner 110 may include an ignition device, such as a spark plug, to combust fuel. The burner 110 combusts the supplied fuel and forms high-temperature exhaust gas.

An air path 111 for supplying external air to the burner 110 may be formed at a predetermined portion near the burner 110. For example, the air path 111 may be at a portion of the cabinet 101 defining an exterior appearance of the gas furnace, corresponding to the burner 110.

The high-temperature exhaust gas generated by the fuel combustion of the burner 110 flows in the exhaust path 120. The exhaust gas 120 may be made of a material with high-heat transmission efficiency for heat exchange between the exhaust gas and the air which will be supplied to the indoor space. That heat exchange will be described later.

In the illustrated embodiment, the exhaust path 120 may include a first heat exchange unit 121 and a second heat exchange unit 122.

The first heat exchange unit 121 may be connected to an outlet end of the burner 110 in a shape of a heat exchange tube having a plurality of curved portions, or, have a corrugated shape. The high-temperature exhaust gas generated by the driving of the burner 110 may flow in the first heat exchange unit 121.

The second heat exchange unit 122 may be provided at a rear end portion of the first heat exchange unit 121. The second heat exchange unit 122 may be configured to branch the exhaust gas guided from the first heat exchange unit 121 to a plurality of micro-paths 1223, so as to improve heat exchange efficiency by increasing a surface-area of the second heat exchange unit.

For example, the second heat exchange unit 122 may include one inlet 1221 for drawing the exhaust gas guided from the first heat exchange unit 121, a plurality of micro-paths branched from the inlet 1221, and an outlet 1222 for discharging the exhaust gas guided via the micro-paths 1223.

The first heat exchange unit 121 may be arranged above the second heat exchange unit 122. The blower 130 which will be described later may be arranged below the second heat exchange unit 122.

The air exhausted from the blower 130 may be initially heat-exchanged with a relatively-low-temperature exhaust gas in the second heat exchange unit 122 and then heat-exchanged with a relatively-high-temperature exhaust gas in the first heat exchange unit 121.

As such, the temperature of the exhaust gas is lowered in the second heat exchange unit 122 so that the vapors contained in the exhaust gas can be condensed. To discharge the water condensed from the exhaust gas outside, a condensed-water path 125 may be connected to an outlet end of the second heat exchange unit 122.

An exhaust pipe 123 may be provided at a rear end portion of the second heat exchange unit 122. A fan 124 for suctioning external air via the air path 111 mentioned above may be provided in the exhaust pipe 123.

The blower 130 may be configured to suction the internal air of the indoor space via the collect path 40. In other words, the internal air may be suctioned into the blower 130 provided in the cabinet 101 via the collect path 40.

The blower 130 may be configured to discharge the suctioned air. For example, the air suctioned through a lateral surface of the cabinet 101 may be exhausted in an upward direction to a top of the cabinet 10 by the blower 130.

As such, the air exhausted by the blower 130 may be heat-exchanged with the exhaust path and guided into the indoor space along the supply path 30. In other words, the internal air of the indoor space 30 is suctioned into the cabinet 101 via the exhaust path 120 by the driving of the blower 130 and then heat-exchanged with the exhaust path 120 to be re-supplied to the indoor space via the supply path.

The fuel supply unit 140 may include a fuel supply line 1410 and a fuel exhaust line 1420 for supplying fuel to the burner 110 and a valve 1430 provided between the fuel supply line 1410 and the fuel exhaust line 1420.

The fuel supply line 1410 may be configured to guide the fuel toward the valve 1430 from an external fuel supply source (not shown). The fuel exhaust line 1420 may be configured to guide the fuel toward the burner 110. The valve 1430 may be configured to adjust an opening degree between the fuel supply line 1410 and the fuel exhaust line 1420.

The amount of the fuel supplied to the burner 110 may be adjusted in a linear shape by the valve 1430. In other words, the heating power of the burner 110 may be adjusted in a predetermined number of power levels in a linear shape by the opening control of the valve 1430.

For example, the gas furnace for heating the indoor space 10 may include one valve 1430 so as to supply fuel and control the opening degree of one valve 1430 so as to control the heating power of the burner 110 in three or more heat levels.

Figures 4A, 4B, 4C:
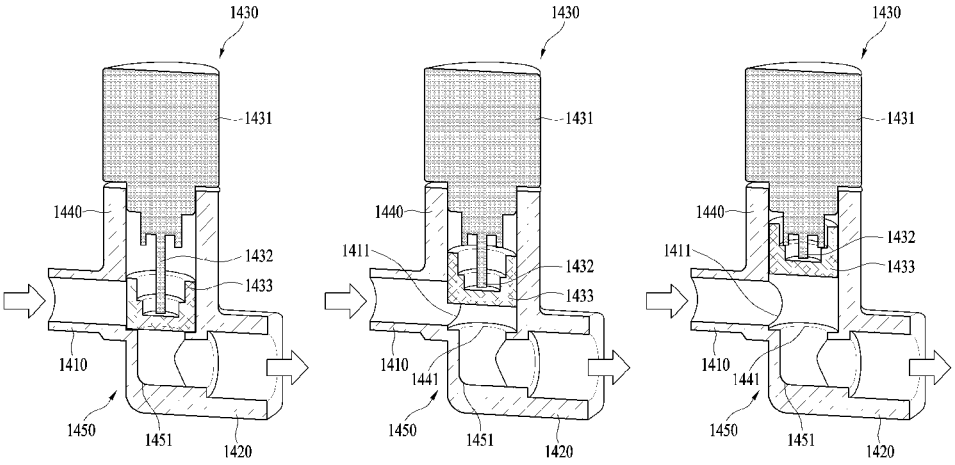
FIG. 4(*a*) is a diagram illustrating the structure of a valve applied to the gas furnace for the indoor space shown in FIG. 3, where the valve is completely closed.

FIGS. 4(*a*), 4(*b*), and 4(*c*) illustrate the structure of the valve 1430 applied to the gas furnace for heating the indoor space shown in FIG. 3.

Specifically, FIG. 4(*a*) illustrates a state where the path of the fuel is completely closed by the valve, and FIG. 4(*b*) illustrates a state where the path of the fuel is partially open along with the linear movement of the valve. FIG. 4 (*c*) illustrates a state where the path of the fuel is completely open.

With reference with FIGS. 3 and 4(*a*)-(*c*), the fuel supply unit 140 may include the fuel supply line 1410, the fuel exhaust line 1420, and the valve 1430 as mentioned above.

The valve 1430 includes a step motor 1431 and a shutting member 1433 coupled to a shaft 1432 of the step motor 1431 and linearly movable by the driving of the step motor 1431.

The linear movement of the shaft 1432 may be determined based on rotational angles of the step motor 1431. The direction of the linear movement of the shaft 4432 may also be determined based on rotational directions of the motor 1431.

The shutting member 1433 may be configured to be coupled to the shaft 1432 of the step motor 1431 and become linearly movable together with the shaft 1432 based on the driving of the step motor 1431. In other words, the distance of the linear movement performed by the shutting member 1433 may be determined based on the rotational angles of the step motor 1432.

The opening degree between the fuel supply line 1410 and the fuel exhaust line 1420 may be adjusted by the linear movement of the shutting member 1433. Specifically, the shutting member 1433 may be configured to adjust an opening degree of an outlet end 1411 formed in the fuel supply line 1410.

The height of the shutting member 1433 may be greater than the diameter of the fuel supply line 1410. More specifically, the height of the shutting member 1433 may be greater than the diameter of the outlet end 1411. The shutting member 1433 linearly moving in an up-and-down direction (e.g., vertical direction) is capable of shutting off the outlet end 1411 of the fuel supply line 1410, in a state where the valve 1430 is completely closed.

Accordingly, the amount of the fuel supplied to the burner 110 may be controlled in a linear shape by the control of the opening degree performed by the shutting member 1433.

Meanwhile, the fuel supply line 1410 and the fuel exhaust line 1420 may be extended in the same direction.

In other words, the fuel supply line 1410 may be parallel with the fuel exhaust line 1420.

When the fuel flowing through the fuel supply line 1410 is supplied to the fuel exhaust line 1420 via the valve 1430, the flow direction of the fuel in the fuel supply line 1410 may be equal to that of the fuel in the fuel exhaust line 1420, which prevent pressure loss caused by variation of the fuel flow direction during the supply of the fuel toward the burner 110.

Meanwhile, the direction in which the shutting member 1433 is linearly moved may be at right angles with respect to the direction in which the fuel supply and exhaust lines 1410 and 1420 are arranged.

In the illustrated embodiment, the fuel supply line 1410 and the fuel exhaust line 1420 are extended in a horizontal direction and the shutting member 1433 is formed between the fuel supply line 1410 and the fuel exhaust line 1420 to linearly move in a vertical direction.

Accordingly, the amount of the fuel flowing to the fuel exhaust line 1420 from the fuel supply line 1410 may be controlled by the step motor 1431 and the shutting member 1433 in a linear form.

The fuel supply unit 140 may further include a guide portion 1440 formed between the fuel supply line 1410 and the fuel exhaust line 1420 to guide the linear movement of the shutting member 1433.

In this instance, an upper end of the guide portion 1440 and a lower end of the step motor 1431 may be sealed to prevent fuel from leaking over the upper end of the guide portion 1440.

The guide portion 1440 may be formed in a cylindrical shape and the shutting member 1433 may be also formed in cylindrical shape. A diameter of the shutting member 1433 may be smaller than a diameter of the guide portion 1440 so as to fit within the guide portion 1440.

Accordingly, a gap may be formed between an outer circumferential surface of the shutting member 1433 and an inner circumferential surface of the guide portion 1440. The shutting member 1433 may linearly move in a vertical direction within an inner space of the guide portion 1440.

Meanwhile, a seating portion 1441 for seating a lower end of the shutting member 1433 may be formed at an inner circumferential surface of the guide portion 1440. For example, the seating portion 1441 may be provided at an inner circumferential surface of the lower end of the guide portion 1440.

The seating portion 1441 may be projected inward with respect to a radial direction of the guide portion 1440. The seating portion 1441 may be extended along an inner circumferential surface of the shutting member 1433.

As shown in FIG. 4(*a*), the lower end of the shutting member 1433 may be in contact with an upper surface of the seating portion 1441 in a state where the valve 1430 is completely closed.

At this time, the seating portion 1441 may be arranged below the lower end of the fuel supply line 1410. In other words, the seating portion 1441 may be disposed below the outlet end 1411 of the fuel supply line 1410 so as to prevent fuel from leaking to the fuel exhaust line 1420 through the gap between the shutting member 1433 and the guide portion 1440.

A step portion 1450 may be provided between the fuel supply line 1410 and the fuel exhaust line 1420. In the illustrated embodiment, the step portion 1450 is shown as being stepped downward. The step portion 1450 makes it possible for the fuel supply line 1410 to be arranged higher than the fuel exhaust line 1420.

The fuel supplied through the fuel supply line 1410 may be supplied to the burner 110 after passing the step portion 1450 and the fuel exhaust line 1420 sequentially.

The fuel exhaust line 1420 is arranged below the fuel supply line 1410 by the step portion 1450 and prevents the fuel from leaking into the fuel exhaust line 1420 through the gap between the shutting member 1433 and the guide portion 1440.

The distance at which the seating portion is projected inward in the guide portion 1440 may be longer than the gap between the shutting member 1433 and the guide portion 1440.

The step portion 1450 may be formed in communication with the guide portion 1440. The fuel supplied to the fuel supply line 1410 may be guided to the fuel exhaust line 1420 via the step portion 1450 according to the opening of the valve 1430.

One or more curved portions 1451 may be provided in the step portion 1450. For example, the curved portion 1451 may be provided at a corner of the step portion 1451 so as to reduce the pressure loss of the fuel flowing from the fuel supply line 1410 to the fuel exhaust line 1420.

The specific control of the components performed by the controller provided in the gas furnace for heating the indoor space according to the illustrated embodiment is described below with reference to the accompanying drawing.

Figure 5:
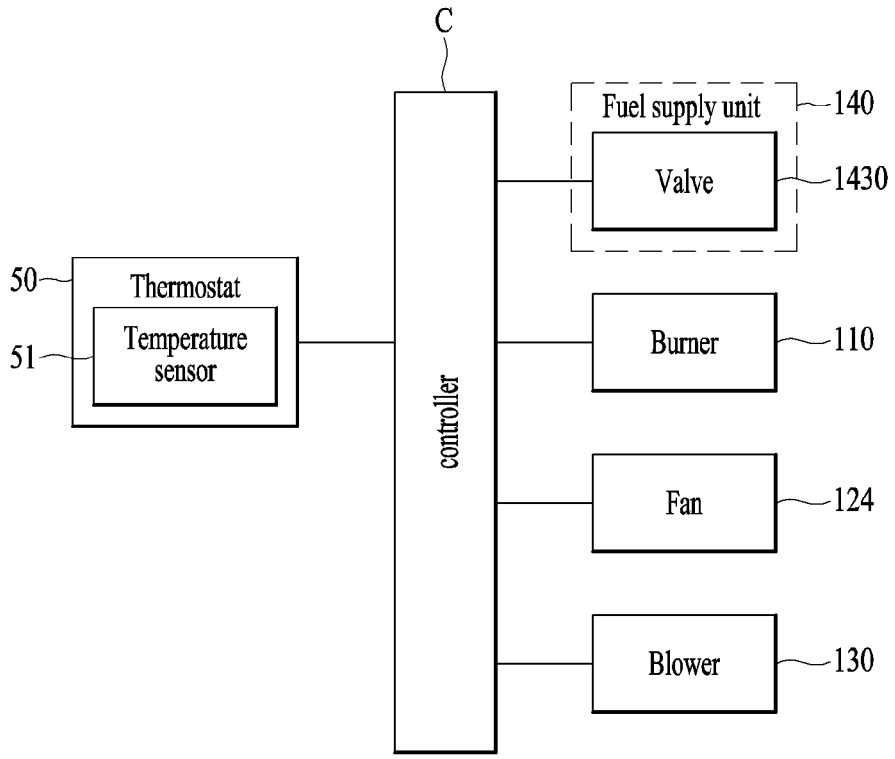
FIG. 5 is a block diagram illustrating a connection relation between a controller provided in the gas furnace for the indoor space shown in FIG. 3, and components that are controlled by the controller.

FIG. 5 is a block diagram illustrating a connection relation between a controller provided in the gas furnace for the indoor space shown in FIG. 3 and components that are controlled by the controller according to an embodiment of the invention.

With reference to FIG. 5, the gas furnace may further include a controller (C) configured to transceiver a signal with a thermostat 50 installed in the indoor space.

The controller (C) may be provided in the thermostat 50. The controller may control the thermostat 50 to selectively generate two signals.

For example, the thermostat 50 provided in the furnace may control a small heating power, a middle heating power, and a large heating power of the burner.

The controller (C) may control the fuel supply unit 140 based on a signal transmitted from the thermostat 50. The controller (C) may control the opening degree of the valve 1430 provided in the fuel supply unit 140 based on the signal transmitted from the thermostat 50.

The controller (C) may also control the driving of the burner 110, the fan 124, and/or the blower 130.

The heating power of the burner 110 may be adjusted according to the opening degree of the valve 1430. For example, the heat power of the burner 110 may be adjusted to three different heat sizes or levels according to the opening degree of the valve 1430.

For purposes of convenience, it is presumed that the heat power of the burner 110 is adjusted to different three heat power levels (e.g., a large heat power, a middle heat power, and a low heat power). Except the case where the valve 1430 is completely closed, the opening degree of the valve 1430 may be adjusted in different three levels. However, it is understood that the heat power of the burner 110 may be adjustable to more than three heat power levels.

An initial heat power of the burner 110 may be controlled based on a target temperature (Ts) set by the user.

More particularly, the controller (C) may initially control the heat power of the burner 110 based on a difference (Ts−Ti) between the preset target temperature (Ts) and the room temperature (Ti) sensed by a temperature sensor 51 provided in the thermostat 50. The controlling of the heat power provided to the burner 110 may be understood to mean the controlling of the opening degree of the valve 1430.

When the difference (Ts−Ti) is smaller than a preset value (A) in the initial control of the controller (C), the controller (C) may control the opening degree of the valve 1430 for the heat power of the burner 110 to be at the middle heat power level for a first time period.

In other words, when the valve (Ts−Ti) is less than the preset value (A) in the initial control of the controller (C), the large heat power level of the burner 110 is not used. If the large heat power level is used in case of a relatively small difference between the target temperature (Ts) and the measured room temperature (Ti), then the measured room temperature (Ti) is not maintained near the target temperature (Ts) and increases above the target temperature (Ts) or decreases below the target temperature (Ts).

When the difference (Ts−Ti) is greater than the preset value (A) in the initial control of the controller (C), the controller (C) may control the opening degree of the valve 1430 for the heat power to be at the large heat power for a third time period after being at the middle heat power for a second time period.

When the valve (Ts−Ti) is greater than the preset value (A) in the initial control of the controller (C), the large heat power of the burner may be used.

At this time, the preset value (A) mentioned above may be determined as an optimal valve gained through repeated experiments, in aspects of heating efficiency and fuel efficiency.

The first and third time periods may be longer than the second time period. The first time period may be longer than the third time period. In other words, the first time period may be longer than the second and third time periods and the third time period may be longer than the second time period.

For example, the first time period may be approximately 110-130 seconds, the second time period may be approximately 20-40 seconds, and the third time period may be approximately 50-70 seconds. Preferably, however, the first time period is approximately 120 seconds, the second time period is approximately 30 seconds, and the third time period is approximately 60 seconds.

The controller (C) may secondly control the heat power of the burner 110 according to whether the room temperature (Ti) reaches the target temperature (Ts) after the initial control. In other words, the controller (C) may receive information about the room temperature (Ti) from the thermostat 50 after the initial control.

In the second control, the controller (C) may control the opening degree of the valve 1430 for the heat power of the burner 110 to become at least one of the small and middle heat powers. The large heat power of the burner 110 may not be used during the second control.

The room temperature (Ti) may reach the target temperature (Ts) or a value near the target temperature (Ts) during the initial control. If the heat power of the burner 110 is controlled in the large heat power in the initial control, the room temperature (Ti) increases much greater than the target temperature (Ts) and there is significant variation range between the target temperature (Ts) and the room temperature (Ti).

Specifically, when the difference valve (Ts−ti) is less than the preset value (A) in the second control of the controller (C), the opening degree of the valve 1430 may be adjusted for the heat power of the burner 110 to be at the small heat power for the third time period. As it is more likely for the room temperature (Ti) to approach the target temperature (Ts) through the first control, the room temperature (Ti) may be controlled not to rise significantly above the target temperature (Ts).

When the difference valve (Ts−Ti) is the preset value (A) or more, the valve 1430 may be controlled to be completely closed by the controller (C).

Meanwhile, when the difference valve (Ts−Ti) is greater than or equal to the preset value (A) after the heat power of the burner 110 is at the small heat power by controlling the opening degree of the valve 1430, the opening of the valve 1430 may be adjusted for the heat power of the burner 110 to be at the middle heat power for the second time period.

In the second control, the controller (C) may adjust the opening degree of the valve 1430 to heat power of the burner 110 to be repeatedly at the small heat power and at the middle heat power, until the room temperature (Ti) reaches at least the target temperature (Ts).

In other words, until the room temperature (Ti) is greater than the target temperature, the controller (C) repeats the opening adjustment of the valve 1430 for the heat power of the burner 110 to be at the middle heat power after the small heat power in the second control. Accordingly, the range between the room temperature (Ti) and the target temperature (Ts) may be minimized by the repeated control of the small heat power and the middle heat power of the burner 110.

As described above, the gas furnace for heating the indoor space may control the heat power of the burner 110 at three or more levels by using the thermostat configured to generate only two signals and the valve 1430 of which the opening degree is adjustable to different sizes. Accordingly, the gas furnace may minimize the temperature variation of the indoor space or room by such the control of the heat power of the burner 110 at three or more heat power levels.

Hereinafter, the controlling method of the gas furnace for heating the indoor space in accordance with one embodiment of the present disclosure will be described with reference to the accompanying drawing.

Figure 6:
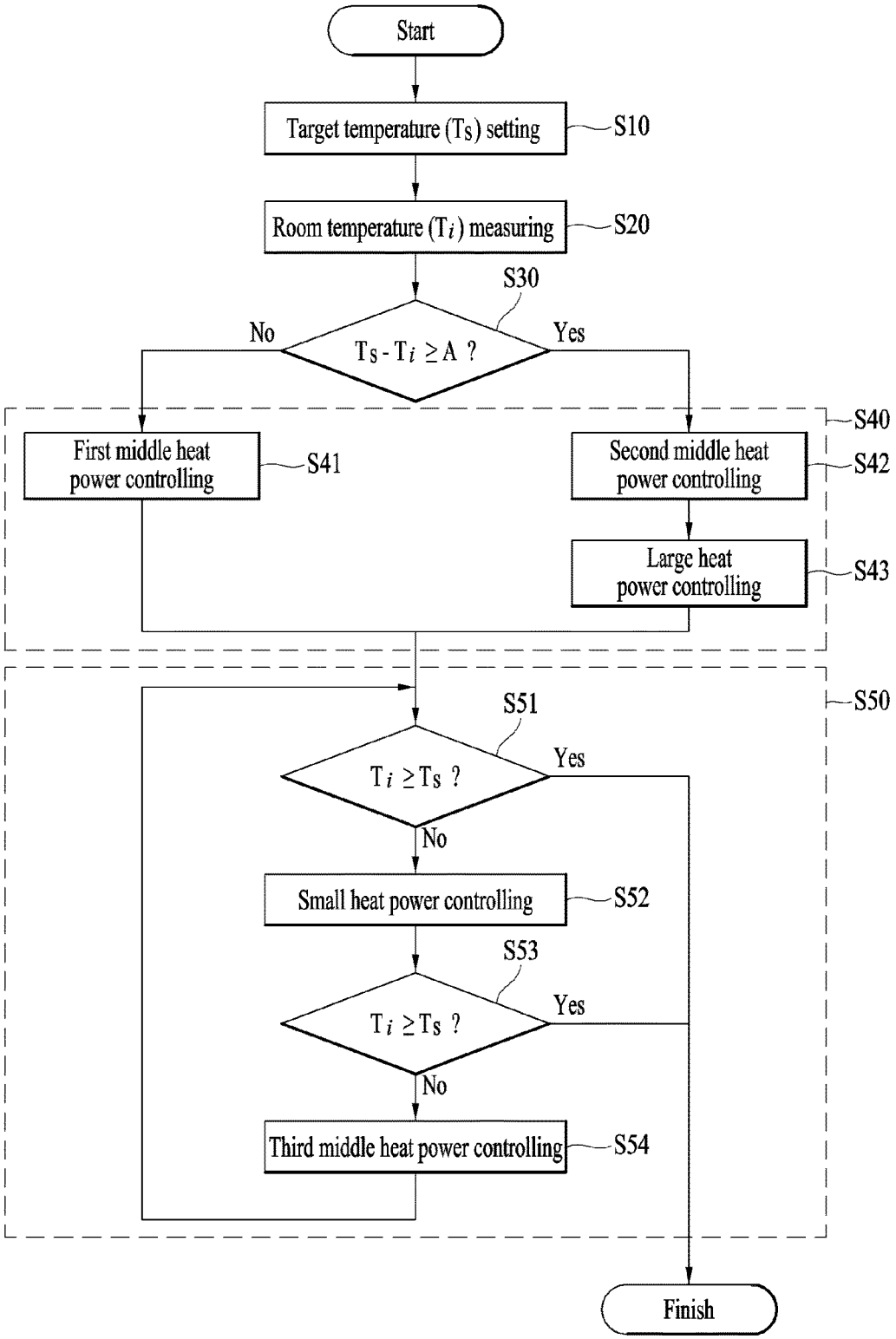
FIG. 6 is a flow chart illustrating a controlling method of the gas furnace for the indoor space in accordance with an embodiment of the present disclosure.

FIG. 6 is a flow chart illustrating a controlling method of the gas furnace for the indoor space in accordance with the present disclosure.

When describing the controlling method of the gas furnace shown in FIG. 6, it is understood that the structure of the gas furnace mentioned above with reference to FIGS. 2 through 5 should be applied to the controlling method.

With reference to FIG. 6, the controlling method of the gas furnace for heating the indoor space in accordance with one embodiment of the present disclosure may include a temperature setting step (S10) for setting the target temperature (Ts) by implementing the thermostat 50; a temperature measuring step (S20) for measuring the room temperature (Ti) by using the temperature sensor 510 provided in the thermostat 50; a first valve controlling step (S40) for controlling the opening degree of the valve for the heat power of the burner 110 to be at least one of the middle heat power and the large heat power, based on a difference (Ts−Ti) between the target temperature (Ts) and the room temperature (Ti); and a second valve controlling step (S50) for controlling the opening degree of the valve 110 for the heat power of the burner 110 to be at least one of the small heat power and the middle heat power, based on the determination about whether the room temperature (ti) reaches the target temperature (TS).

During the temperature setting step (S10), the user may set the target temperature (Ts) by using the thermostat 50 (e.g., temperature regulator). For example, the thermostat 50 may include an input unit (not shown) for allowing the user to input the target temperature (Ts).

During the temperature measuring step (S20), the temperature sensor 51 provided in the thermostat 50 may be implemented to measure the room temperature (Ti). The temperature sensor 51 measures the room temperatures (Ti) in real time and transmits the measured room temperatures to the controller (C) via the thermostat 50.

At (S30), the difference between the target temperature (Ts) and the room temperature (Ti) is calculated and compared with the preset value (A) (S30).

Hence, in the first valve controlling step (S30), the opening degree of the valve 1430 may be controlled for the heat power of the burner 110 to be at least one of the middle and large heat powers, based on the result of the comparison between the difference valve (Ts−Ti) and the preset value (A).

For example, when the difference valve (Ts−Ti) is less than the preset value (A), the first valve controlling step (S40) may include a first middle heat power controlling step (S41) for controlling the opening degree of the valve 1430 for the heat power of the burner 110 to be at the middle heat power for the first time period.

During the first middle heat power controlling step (S410), the heat power of the burner 110 is kept as the middle heat power for the first time period by controlling the opening degree of the valve 1430. In other words, when the difference valve (Ts−ti) is less than the preset value (A), the first valve controlling step (S40) may include only the first middle heat power controlling step (S41).

When the difference valve (Ts−Ti) is greater than or equal to the preset value (A), the first valve controlling step (S41) may further include a second middle heat power controlling step (S42) for controlling the opening degree of the valve 1430 for the heat power of the burner 110 to be at the middle heat power for the second time period; and at a large heat power controlling step (S43) for controlling the opening degree of the valve 1430 for the heat power of the burner to be at the large heat power after the second middle heat power controlling step (S42).

In the second middle heat power controlling step (S42), the heat power of the burner 110 is kept at the middle heat power for the second time period and then the large heat power controlling step (S43) starts. In the large heat power controlling step (S43), the heat power of the burner 110 is kept at the large heat power for the third time period. In other words, when the difference valve (Ts−Ti) is greater than or equal to the preset value (A), the first valve controlling step (S40) may include only the second middle heat power controlling step (S42) and the large heat power controlling step (S43).

During the first valve controlling step (S40) described above, the room temperature (Ti) can rapidly approach the target temperature (Ts).

After the first valve controlling step (S40), the controller (C) may receive real-time room temperatures (Ti) from the thermostat 50. In other words, the controller (C) may receive the real-time room temperatures (Ti) from the thermostat 50 immediately after the first valve controlling step (S40) ends.

Accordingly, the second valve controlling step (S50) after the first valve controlling step (S40) may include a first determining step (S51) for determining whether the room temperature (Ti) rises above the target temperature (Ts); and a small heat power controlling step (S52) for controlling the heat power of the burner 110 to be at the small heat power based on the result of the determination in the first determining step (S51).

During the first determining step (S51), it may be determined whether the room temperature (Ti) after the first valve controlling step (S40) rises to greater than or equal to the target temperature (Ts). In other words, the room temperature (Ti) measured by the temperature sensor 51 before the first determining step (S510) may be transmitted to the controller (C) via the thermostat 50.

When it is determined in the first determining step (S51) that the room temperature (Ti) is less than the target temperature (Ts), the opening degree of the valve 1430 may be controlled for the heat power of the burner 110 to be at the small heat power for the third time period in the small heat power controlling step (S52).

When it is determined in the first determining step (S51) that the room temperature (Ti) is greater than or equal to the target temperature (Ts), the controller (C) may completely control the valve 1430 and the warm air heated by using the latent heat of the exhaust path may be supplied to the room or indoor space by additional driving of the blower.

The second valve controlling step (S52) may further include a second determining step (S53) for determining whether the room temperature (Ti) is greater than or equal to the target temperature (Ts) after the small heat power controlling step (S52); and a third middle heat power controlling step (S54) for controlling the heat power of the burner 110 to be at the middle heat power based on the result of the determination made in the second determining step (S53).

In the second determining step (S53), the controller (C) may determine whether the room temperature (Ti) measured after the small heat power controlling step (S52) is greater than or equal to the target temperature (Ts).

In other words, the controller (C) may receive real-time room temperatures (Ti) from the thermostat 50 between the small heat power step (S52) and the second determining step (S53). Specifically, the thermostat 50 may transmit the indoor temperatures (Ti) measured by the temperature sensor 51 before the second determining step (S53) to the controller (C).

When it is determined in the second determining step (S53) that the room temperature (Ti) is less than the target temperature (Ts), the opening degree of the valve 1430 may be controlled in the third middle heat power controlling step (S54) for the heat power of the burner 110 to be at the middle heat power for the second time period.

When it is determined in the second determining step (S53) that the room temperature (Ti) is greater than or equal to the target temperature (Ts), the controller (C) may completely close the valve 1430 and the warm air heated by using the latent heat of the exhaust path may be supplied to the room or indoor space by additional driving of the blower.

Meanwhile, the small heat power controlling step (S510) and the third middle heat power controlling step (S54) that are provided in the second valve controlling step (S50) may be repeatedly performed until the room temperature (Ti) is greater than or equal to the target temperature (Ts).

Specifically, the room temperature (Ti) may be transmitted to the controller (C) by the thermostat 50 in real time. The controller (C) may determine whether the room temperature (Ti) is greater than or equal to the target temperature (Ts) through the first determining step (S51) and the second determining step (S52).

At this time, the small heat power controlling step (S51) and the third middle heat power controlling step (S54) may be performed sequentially and repeatedly, until it is determined in the first determining step (SM) or the second determining step (S52) that the room temperature (Ti) is greater than or equal to the target temperature (Ts).

The sequential and repeated performance of the small heat power controlling step (SM) and the third middle heat power controlling step (S54) may minimize the variation range between the room temperature (Ti) and the target temperature (Ts).

It is understood that various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A gas furnace for heating an indoor space comprising:

a burner that combusts fuel to form a high-temperature exhaust gas;

an exhaust path through which the exhaust gas flows;

a blower that suctions internal air via a suction path;

a supply path that guides the internal air exhausted by the blower toward the indoor space after the internal air is heat-exchanged;

a valve having an opening degree that is controllable so as to controllably open a fuel supply line and supply a predetermined heat-power-based amount of fuel to the burner via a fuel exhaust line; and a controller that controls the opening degree of the valve based on a signal transmitted from a thermostat installed in the indoor space, wherein the heat power of the burner is controlled at a plurality of heat power levels based on the opening degree of the valve, wherein the fuel flowing through the fuel supply line and the fuel exhaust line flows in a plurality of directions including a first direction corresponding to a extending direction of the fuel supply line and the fuel exhaust line and a second direction crossing the first direction, whereby the first direction is not opposite the second direction, wherein the valve comprises a step motor and a shutting member coupled to a shaft of the step motor, the shutting member being linearly moved by the driving of the step motor, wherein an opening degree between the fuel supply line and the fuel exhaust line is adjusted by the linear movement of the shutting member, wherein a fuel supply unit comprises a guide portion formed between the fuel supply line and the fuel exhaust line to guide the linear movement of the shutting member, and a seating portion for seating a lower end of the shutting member is formed at an inner circumferential surface of the guide portion and projected toward an inside of the guide portion to provide a seating surface for a bottom end of the shutting member, and wherein a portion of a side surface of the shutting member contacts the fuel supply line when the valve is closed.

2. The gas furnace of claim 1, wherein the heat power is controlled to be at a first heat power, a second heat power and a third heat power based on the opening degree of the valve, whereby the third heat power is greater than the second heat power and the second heat power is greater than the first heat power.

3. The gas furnace of claim 2, wherein the controller performs a first control for controlling the heat power based on the difference between a preset target temperature (Ts) and the room temperature (Ti) sensed by a temperature sensor provided in the thermostat, and when the difference (Ts−Ti) is less than a preset value, the opening degree of the valve is controlled for the heat power of the burner to be at the second heat power for a first time period in the first control, and when the difference (Ts−Ti) is greater than or equal to the preset value, the opening degree of the valve is controlled for the heat power of the burner to be at the second heat power for a second time period and then at the third heat power for a third time period in the first control.

4. The gas furnace of claim 3, wherein the first time period and the third time period are longer than the second time period, and the first time period is longer than the third time period.

5. The gas furnace of claim 4, wherein the controller performs a second control for controlling the heat power based on determination by the controller about whether the room temperature (Ti) is greater than or equal to the preset target temperature (Ts) after the first control, and the opening degree of the valve is controlled by the controller so that the heat power is at least one of the first heat power and the second heat power in the second control, wherein in the second control, the controller controls the opening degree of the valve for the heat power to be at the first heat power for the third time period when the room temperature (Ti) is lower than the preset target temperature (Ts) and controls the valve to be closed when the room temperature (Ti) is greater than or equal to the preset target temperature (Ts).

6. The gas furnace of claim 1, wherein the controller controls the opening degree of the valve for the heat power to be at the second heat power for the second time period when the room temperature (Ti) is lower than the preset target temperature (Ts) after the controller has controlled the opening degree of the valve for the heat power of the burner to be at the first heat power.

7. The gas furnace of claim 6, wherein the controller repeats the control of the valve opening degree for the heat power to be at the second heat power after the first heat power until the room temperature (Ti) is greater than or equal to the preset target temperature (Ts) in the second control.

8. The gas furnace of claim 1, wherein the fuel supply line and the fuel exhaust line are extended in the same direction.

9. The gas furnace of claim 8, wherein the fuel supply line and the fuel exhaust line are arranged in parallel, and the direction in which the shutting member is linearly moved is perpendicular to the direction in which the fuel supply line and the fuel exhaust line extend.

10. The gas furnace of claim 1, wherein the seating portion extends along the inner circumferential surface of the guide portion, and the seating portion is arranged below a bottom end of the fuel supply line.

11. A controlling method of a gas furnace for heating an indoor space comprising a controller controlling an opening degree of a valve supplying fuel to a burner so as to controllably open a fuel supply line and supply a predetermined heat-power based amount of fuel to the burner via a fuel exhaust line, the controlling being based on a signal transmitted from a thermostat installed in the indoor space, the controlling method comprising:

a temperature setting step for setting a target temperature via the thermostat;

a temperature measuring step for measuring a room temperature by using a temperature sensor provided in the thermostat;

a first valve controlling step, using the controller, for controlling the opening of the valve for the heat power of the burner to be at least one of a second heat power and a third heat power, based on a temperature difference between the target temperature and the room temperature; and a second valve controlling step for controlling the opening degree of the valve for the heat power of the burner to be at least one of a first heat power and the second heat power, based on a determination about whether the room temperature reaches the target temperature, wherein the third heat power is greater than the second heat power and the second heat power is greater than the first heat power, wherein the fuel flowing through the fuel supply line and the fuel exhaust line flows in a plurality of directions including a first direction corresponding to a extending direction of the fuel supply line and the fuel exhaust line and a second direction crossing the first direction, whereby the first direction is not opposite the second direction, wherein the valve comprises a step motor and a shutting member coupled to a shaft of the step motor, the shutting member being linearly moved by the driving of the step motor, wherein an opening degree between the fuel supply line and the fuel exhaust line is adjusted by the linear movement of the shutting member, wherein a fuel supply unit comprises a guide portion formed between the fuel supply line and the fuel exhaust line to guide the linear movement of the shutting member, and a seating portion for seating a lower end of the shutting member is formed at an inner circumferential surface of the guide portion and projected toward an inside of the guide portion to provide a seating surface for a bottom end of the shutting member, and wherein a portion of a side surface of the shutting member contacts the fuel supply line when the valve is closed.

12. The controlling method of claim 11, wherein the first valve controlling step comprises, a first middle heat power controlling step for controlling the opening of the valve for the heat power of the burner to be the second heat power for a first time period, when the difference (Ts−Ti) is less than a preset value;

a second middle heat power controlling step for controlling the opening of the valve for the heat power of the burner to be the second heat power for a second time period, when the difference (Ts−Ti) is greater than or equal to the preset value; and a large heat power controlling step for controlling the opening degree of the valve for the heat power of the burner to be the third heat power for a third time period after the second second heat power controlling step.

13. The controlling method of claim 11, wherein the second valve controlling step comprises, a first determining step for determining whether the room temperature is greater than or equal to the target temperature; and a small heat power controlling step for controlling the opening degree of the valve for the heat power of the burner to be the first heat power for the third time period, when it is determined in the first determining step that the room temperature is less than the target temperature.

14. The controlling method of claim 13, further comprising:

a second determining step for re-determining whether the room temperature is greater than or equal to the target temperature after the first heat power controlling step; and a third middle heat power controlling step for controlling the opening degree of the valve for the heat power of the burner to be the second heat power for the second time period, when it is determined in the second determining step that the room temperature is less than the target temperature.

15. The controlling method of claim 14, wherein the first heat power controlling step and the third second heat power step are performed sequentially and repeatedly, until the room temperature is greater than or equal to the target temperature.

16. The controlling method of claim 14, wherein the room temperatures measured by the temperature sensor before the first determining step and the second determining step are transmitted from the thermostat to the controller.

17. The controlling method of claim 12, wherein the first time period and the third time period are longer than the second time period, and the first time period is longer than the third time period.

* * * * *